US007618927B2

(12) United States Patent
Massam et al.

(10) Patent No.: US 7,618,927 B2
(45) **Date of Patent: *Nov. 17, 2009**

(54) INCREASED RATE OF PENETRATION FROM LOW RHEOLOGY WELLBORE FLUIDS

(75) Inventors: Jarrod Massam, Aberdeen (GB); Doug Oakley, Wiltshire (GB); Todd Reid, Mount Pearl (CA); Andrew Bradbury, Kincardineshire (GB)

(73) Assignee: M-I L.L.C., Houston, TX (US)

( * ) Notice: Subject to any disclaimer, the term of this patent is extended or adjusted under 35 U.S.C. 154(b) by 445 days.

This patent is subject to a terminal disclaimer.

(21) Appl. No.: 11/741,689

(22) Filed: Apr. 27, 2007

(65) Prior Publication Data

US 2007/0281867 A1 Dec. 6, 2007

Related U.S. Application Data

(63) Continuation-in-part of application No. 11/162,850, filed on Sep. 26, 2005, now Pat. No. 7,589,049, which is a continuation of application No. 10/274,528, filed on Oct. 18, 2002, now abandoned, which is a continuation-in-part of application No. 09/230,302, filed as application No. PCT/EP97/03802 on Jul. 16, 1997, now Pat. No. 6,586,372, application No. 11/741,689, which is a continuation-in-part of application No. 11/617,576, filed on Dec. 28, 2006, now Pat. No. 7,409,994, which is a continuation of application No. 11/145,054, filed on Jun. 3, 2005, now Pat. No. 7,176,165, application No. 11/741,689, which is a continuation-in-part of application No. 11/617,031, filed on Dec. 28, 2006, which is a continuation of application No. 11/145,053, filed on Jun. 3, 2005, now Pat. No. 7,169,738, application No. 11/741,689, which is a continuation-in-part of application No. 11/741,199, filed on Apr. 27, 2007, and a continuation-in-part of application No. 11/145,259, filed on Jun. 3, 2005, now Pat. No. 7,220,707.

(60) Provisional application No. 60/576,420, filed on Jun. 3, 2004, provisional application No. 60/825,156, filed on Sep. 11, 2006.

(30) Foreign Application Priority Data

Jul. 24, 1996 (GB) ..... 9615549.4

(51) Int. Cl.
*C09K 8/74* (2006.01)

(52) U.S. Cl. ..... 507/269; 166/305.1

(58) Field of Classification Search ..... 507/269; 166/305.1

See application file for complete search history.

(56) References Cited

U.S. PATENT DOCUMENTS

| | | | | |
|---|---|---|---|---|
| 3,057,797 | A | 10/1962 | Anderson et al. | |
| 3,880,764 | A | 4/1975 | Donham | |
| 4,166,582 | A * | 9/1979 | Falcon-Steward | 241/16 |
| 6,548,452 | B1 | 4/2003 | Nattier et al. | |
| 6,586,372 | B1 | 7/2003 | Bradbury et al. | |
| 7,176,165 | B2 | 2/2007 | Massam et al. | |
| 2003/0203822 | A1 | 10/2003 | Bradbury et al. | |
| 2004/0127366 | A1 | 7/2004 | Bradbury et al. | |
| 2005/0101493 | A1 | 5/2005 | Bradbury et al. | |
| 2005/0118742 | A1 | 6/2005 | Henning et al. | |
| 2005/0277551 | A1 | 12/2005 | Massam et al. | |
| 2005/0277553 | A1 | 12/2005 | Massam et al. | |
| 2006/0188651 | A1 | 8/2006 | Bradbury et al. | |
| 2007/0184987 | A1 | 8/2007 | Brandbury et al. | |
| 2007/0281867 | A1 | 12/2007 | Massam et al. | |
| 2007/0287637 | A1 | 12/2007 | Bradbury et al. | |

FOREIGN PATENT DOCUMENTS

| | | |
|---|---|---|
| GB | 605173 | 7/1948 |
| WO | 2005118742 | 12/2005 |
| WO | 2006/056774 A2 | 6/2006 |

OTHER PUBLICATIONS

PCT International Search Report dated Feb. 29, 2008 issued in Application No. PCT/US2007/078159 (4 pages).

PCT Written Opinion dated Feb. 29, 2008 issued in Application No. PCT/US2007/078159 (9 pages).

C. W. Blount, "Synthesis of barite, celestinte, anglesite, witherite and strontianite from aqueous solutions" American Mineralogist, vol. 59, 1974, pp. 1209-1219.

Hon Chung Lau et al., United States Statutory Invention Registration, issued under Registration No. H1685, published on Oct. 7, 1997 (2 pages).

U.S. Office Action issued in U.S. Appl. No. 11/767,143 dated Jun. 25, 2008 (7 pages).

Gunnar Fimreite et al. Invert Emulsion Fluids for Drilling Through Narrow Hydraulic Windows, IADC/SPE 87128 Drilling Conference, pp. 1-14 (2004).

(Continued)

*Primary Examiner*—Randy Gulakowski
*Assistant Examiner*—Alicia M Toscano
(74) *Attorney, Agent, or Firm*—Osha • Liang LLP

(57) ABSTRACT

A method of increasing a rate of penetration when drilling as compared to drilling with a baseline drilling fluid comprising an API-grade barite weighting agent and having a given sag, settling rate, density, flow rate, and pressure drop through a wellbore, comprising: circulating a drilling fluid comprising a base fluid and a micronized weighting agent through the wellbore; wherein the drilling fluid is characterized as having an equivalent density, an equivalent or lower settling rate, and an equivalent or lower sag than the baseline drilling fluid; wherein the circulating is at a higher flow rate than the baseline drilling fluid flow rate; and wherein the circulating results in an equivalent or lower pressure drop through the wellbore.

14 Claims, No Drawings

OTHER PUBLICATIONS

Extended European Search Report issued in Application No. 07798639.6 dated Aug. 27, 2009 (8 pages).
Extended European Search Report Issued in Application No. 07784448.8 dated Aug. 27, 2009 (8 pages).
PCT International Search Report issued in PCT Application No. PCT/US2007/071344 dated Oct. 19, 2007 (3 pages).
PCT Written Opinion issued in PCT Application No. PCT/US2007/071344 dated Oct. 19, 2007 (6 pages).

* cited by examiner

INCREASED RATE OF PENETRATION FROM LOW RHEOLOGY WELLBORE FLUIDS

CROSS-REFERENCE TO RELATED APPLICATIONS

This application is a continuation-in-part application of U.S. patent application Ser. No. 11/162,850, which is a continuation application of U.S. patent application Ser. No. 10/274,528, which is a continuation-in-part of U.S. application Ser. No. 09/230,302, now U.S. Pat. No. 6,586,372, which is the U.S. national phase application under 35 U.S.C. §371 of a PCT International Application No. PCT/EP97/003,802, filed Jul. 16, 1997 which in turn claims priority under the Paris Convention to United Kingdom Patent Application No. 9615549.4 filed Jul. 24, 1996. This application is also a continuation-in-part application of U.S. patent application Ser. No. 11/617,576, which is a continuation application of U.S. patent application Ser. No. 11/145,054, now U.S. Pat. No. 7,176,165, which claims priority to U.S. Provisional Application Ser. No. 60/576,420. This application is also a continuation-in-part application of co-pending U.S. patent application Ser. No. 11/617,031, which is a continuation application of U.S. patent application Ser. No. 11/145,053, now U.S. Pat. No. 7,169,738, which claims priority to U.S. Provisional Application Ser. No. 60/576,420. This application is also a continuation-in-part application of co-pending U.S. patent application Ser. No. 11/145,259, which claims priority to U.S. Provisional Application Ser. No. 60/576,420. This application is also a continuation-in-part application of U.S. patent application Ser. No. 11/741,199, which claims priority to U.S. Provisional Application Ser. No. 60/825,156. Each of the above listed priority documents is hereby incorporated by reference.

BACKGROUND OF DISCLOSURE

1. Field of the Disclosure

Embodiments disclosed herein relate generally to drilling an earth formation using a drilling fluid. In other aspects, embodiments disclosed herein relate to increasing rates of penetration when drilling an earth formation by using a drilling fluid comprising a base fluid and a micronized weighting agent, either coated or uncoated.

2. Background

Various fluids are used when drilling or completing a well, and the fluids may be used for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for emplacing a packer, abandoning the well or preparing the well for abandonment, and otherwise treating the well or the formation.

In general, drilling fluids should be pumpable under pressure down through strings of drilling pipe, then through and around the drilling bit head deep in the earth, and then returned back to the earth surface through an annulus between the outside of the drill stem and the hole wall or casing. Beyond providing drilling lubrication and efficiency, and retarding wear, drilling fluids should suspend and transport solid particles to the surface for separation and disposal. In addition, the fluids should be capable of suspending additive weighting agents (to increase specific gravity of the mud), generally finely ground barites (barium sulfate), and transport clay and other substances capable of adhering to and coating the borehole surface.

Drilling fluids are generally characterized as thixotropic fluid systems. That is, they exhibit low viscosity when sheared, such as when in circulation (as occurs during pumping or contact with the moving drilling bit). However, when the shearing action is halted, the fluid should be capable of suspending the solids it contains to prevent gravity separation. In addition, when the drilling fluid is under shear conditions and a free-flowing near-liquid, it must retain a sufficiently high enough viscosity to carry all unwanted particulate matter from the bottom of the well bore to the surface. The drilling fluid formulation should also allow the cuttings and other unwanted particulate material to be separated from the liquid fraction after transport to the surface.

There is an increasing need for drilling fluids having the rheological profiles that enable wells, especially deep or horizontal wells, to be drilled more easily. Drilling fluids having tailored rheological properties ensure that cuttings are removed from the wellbore as efficiently and effectively as possible to avoid the formation of cuttings beds in the well which can cause the drill string to become stuck, among other issues. There is also the need from a drilling fluid hydraulics perspective (equivalent circulating density) to reduce the pressures required to circulate the fluid, this helps to avoid exposing the formation to excessive forces that can fracture the formation causing the fluid, and possibly the well, to be lost. In addition, an enhanced profile is necessary to prevent settlement or sag of the weighting agent in the fluid, if this occurs it can lead to an uneven density profile within the circulating fluid system, which can result in loss of well control, such as due to gas/fluid influx, and wellbore stability problems, such as caving and fractures.

Fluid characteristics required to meet these challenges include, for instance, that the fluid must be easy to pump, requiring the minimum amount of pressure to force the fluid through restrictions in the circulating fluid system, such as bit nozzles or down-hole tools. In other words, the fluid should have the lowest possible viscosity under high shear conditions. Conversely, in zones of the well where the flow area is large, velocity of the fluid is low, where there are low shear conditions, or when the fluid is static, the viscosity of the fluid should be as high as possible in order to prevent settlement, suspend, and transport the weighting material and drilled cuttings. However, it should also be noted that the viscosity of the fluid should not continue to increase under static conditions to unacceptable levels. Otherwise, when fluid circulation is regained, this can lead to excessive pressures that can fracture the formation or alternatively can lead to lost time if the force required to regain a fully circulating fluid system is beyond the limits of the pumps.

Wellbore fluids must also contribute to the stability of the well bore, and control the flow of gas, oil or water from the pores of the formation in order to prevent, for example, the flow or blow out of formation fluids or the collapse of pressured earth formations. The column of fluid in the hole exerts a hydrostatic pressure proportional to the depth of the hole and the density of the fluid. High-pressure formations may require a fluid with a specific gravity of 3.0 or higher.

A variety of materials are presently used to increase the density of wellbore fluids. These include dissolved salts such as sodium chloride, calcium chloride, and calcium bromide.

Alternatively, powdered minerals such as barite, calcite and hematite are added to a fluid to form a suspension of increased density. The use of finely divided metal, such as iron, as a weighting material in a drilling fluid, wherein the weighting material includes iron/steel ball-shaped particles having a diameter less than 250 microns and preferentially between 15 and 75 microns, has also been described. The use of finely powdered calcium or iron carbonate has also been proposed; however, the plastic viscosity of such fluids rapidly increases as the particle size decreases, limiting the utility of these materials.

Conventional weighting agents such as powdered barite exhibit an average particle diameter ($d_{50}$) in the range of 10-30 microns. To adequately suspend these materials requires the addition of a gellant such as bentonite for water-based fluids, or organically modified bentonite for oil-based fluids. A soluble polymer viscosifier such as xanthan gum may also be added to slow the rate of the sedimentation of the weighting agent. However, as more gellant is added to increase the suspension stability, the fluid viscosity (plastic viscosity and/or yield point) increases undesirably resulting in reduced pumpability. This is also the case if a viscosifier is used to maintain a desirable level of solids suspension.

The sedimentation (or "sag") of particulate weighting agents becomes more critical in wellbores drilled at high angles from the vertical, in that a sag of, for example, one inch (2.54 cm) can result in a continuous column of reduced density fluid along the upper portion of the wellbore wall. Such high angle wells are frequently drilled over large distances in order to access, for example, remote portions of an oil reservoir. In such instances it is important to minimize a drilling fluid's plastic viscosity in order to reduce the pressure losses over the borehole length. At the same time a high density also should be maintained to prevent a blow out. Further, as noted above with particulate weighting materials the issues of sag become increasingly important to avoid differential sticking or the settling out of the particulate weighting agents on the low side of the wellbore.

Being able to formulate a drilling fluid having a high density and a low plastic viscosity is also important in deep high pressure wells where high-density wellbore fluids are required. High viscosities can result in an increase in pressure at the bottom of the hole under pumping conditions. This increase in "Equivalent Circulating Density" can result in opening fractures in the formation, and serious losses of the wellbore fluid into the fractured formation. Again the stability of the suspension is important in order to maintain the hydrostatic head to avoid a blow out. The goal of high-density fluids with low viscosity plus minimal sag of weighting material continues to be a challenge. Thus, there is a need for materials that increase fluid density while simultaneously providing improved suspension stability and minimizing both fluid loss and increases in viscosity.

SUMMARY OF THE DISCLOSURE

In one aspect, embodiments disclosed herein relate to a method of increasing a rate of penetration when drilling as compared to drilling with a baseline drilling fluid comprising an API-grade barite weighting agent and having a given sag, settling rate, density, flow rate, and pressure drop through a wellbore, comprising: circulating a drilling fluid comprising a base fluid and a weighting agent through the wellbore; wherein the weighting agent includes at least one micronized weighting agent; wherein the drilling fluid is characterized as having an equivalent density, an equivalent or lower settling rate, and an equivalent or lower sag than the baseline drilling fluid; wherein the circulating is at a higher flow rate than the baseline drilling fluid flow rate; and wherein the circulating results in an equivalent or lower pressure drop through the wellbore.

In another aspect, embodiments disclosed herein relate to a method of drilling a wellbore, comprising: circulating a drilling fluid comprising a base fluid and at least one micronized weighting agent through the wellbore; wherein the drilling fluid comprising at least one micronized weighting agent has a given weight, sag, and settling rate; and wherein the drilling is characterized as having an improved rate of penetration as compared to drilling with a drilling fluid comprising an API-grade barite weighting agent having a similar weight, sag, and settling rate.

Other aspects and advantages of the invention will be apparent from the following description and the appended claims.

DETAILED DESCRIPTION

In one aspect, embodiments disclosed herein relate to drilling an earth formation using a drilling fluid. In other aspects, embodiments disclosed herein relate to increasing rates of penetration when drilling an earth formation by using a drilling fluid comprising a base fluid and a micronized weighting agent. In other aspects, embodiments disclosed herein relate to increasing rates of penetration when drilling an earth formation by using a drilling fluid comprising a base fluid and a dispersant coated micronized weighting agent. Drilling fluids disclosed herein comprising micronized and/or dispersant coated micronized weighting agents may provide for greater rates of penetration as compared to typical drilling fluids of similar density, sag, and settling properties, such as those formed with API-grade barite.

One characteristic of the fluids used in some embodiments disclosed herein is that the particles form a stable suspension, and do not readily settle out. A desirable characteristic of the fluids used in some embodiments disclosed herein is that the suspension exhibits a low viscosity under shear, facilitating pumping and minimizing the generation of high pressures. Another characteristic of the fluids used in some embodiments disclosed herein is that the fluid slurry exhibits low filtration rates (fluid loss).

Fluids used in embodiments disclosed herein may include micronized weighting agents. In some embodiments, the micronized weighting agents may be uncoated. In other embodiments, the micronized weighting agents may be coated with a dispersant. For example, fluids used in some embodiments disclosed herein may include dispersant coated micronized weighting agents. The coated weighting agents may be formed by either a dry coating process or a wet coating process. Weighting agents suitable for use in other embodiments disclosed herein may include those disclosed in U.S. Patent Application Publication Nos. 20040127366, 20050101493, 20060188651, U.S. Pat. Nos. 6,586,372 and 7,176,165, and U.S. Provisional Application Ser. No. 60/825,156, each of which is hereby incorporated by reference.

Micronized weighting agents used in some embodiments disclosed herein may include a variety of compounds well known to one of skill in the art. In a particular embodiment, the weighting agent may be selected from one or more of the materials including, for example, barium sulphate (barite), calcium carbonate (calcite), dolomite, ilmenite, hematite or other iron ores, olivine, siderite, manganese oxide, and strontium sulphate. One having ordinary skill in the art would recognize that selection of a particular material may depend largely on the density of the material as typically, the lowest wellbore fluid viscosity at any particular density is obtained by using the highest density particles. However, other considerations may influence the choice of product such as cost, local availability, the power required for grinding, and whether the residual solids or filter cake may be readily removed from the well.

In one embodiment, the micronized weighting agent may have a $d_{90}$ ranging from 1 to 25 microns and a $d_{50}$ ranging from 0.5 to 10 microns. In another embodiment, the micronized weighting agent includes particles having a $d_{90}$ ranging from 2 to 8 microns and a $d_{50}$ ranging from 0.5 to 5 microns. One of ordinary skill in the art would recognize that, depending on the sizing technique, the weighting agent may have a particle size distribution other than a monomodal distribution. That is, the weighting agent may have a particle size distribution that, in various embodiments, may be monomodal, which may or may not be Gaussian, bimodal, or polymodal.

It has been found that a predominance of particles that are too fie (i.e. below about 1 micron) results in the formation of a high rheology paste. Thus it has been unexpectedly found that the weighting agent particles must be sufficiently small to avoid issues of sag, but not so small as to have an adverse impact on rheology. Thus weighting agent (barite) particles meeting the particle size distribution criteria disclosed herein may be used without adversely impacting the rheological properties of the wellbore fluids. In one embodiment, a micronized weighting agent is sized such that: particles having a diameter less than 1 microns are 0 to 15 percent by volume; particles having a diameter between 1 microns and 4 microns are 15 to 40 percent by volume; particles having a diameter between 4 microns and 8 microns are 15 to 30 by volume; particles having a diameter between 8 microns and 12 microns are 5 to 15 percent by volume; particles having a diameter between 12 microns and 16 microns are 3 to 7 percent by volume; particles having a diameter between 16 microns and 20 microns are 0 to 10 percent by volume; particles having a diameter greater than 20 microns are 0 to 5 percent by volume. In another embodiment, the micronized weighting agent is sized so that the cumulative volume distribution is: less than 10 percent or the particles are less than 1 microns; less than 25 percent are in the range of 1 microns to 3 microns; less than 50 percent are in the range of 2 microns to 6 microns; less than 75 percent are in the range of 6 microns to 10 microns; and less than 90 percent are in the range of 10 microns to 24 microns.

The use of micronized weighting agents has been disclosed in U.S. Patent Application Publication No. 20050277553 assigned to the assignee of the current application, and herein incorporated by reference. Particles having these size distributions may be obtained by several means. For example, sized particles, such as a suitable barite product having similar particle size distributions as disclosed herein, may be commercially purchased. A coarser ground suitable material may be obtained, and the material may be further ground by any known technique to the desired particle size. Such techniques include jet-milling, high performance dry milling techniques, or any other technique that is known in the art generally for milling powdered products. In one embodiment, appropriately sized particles of barite may be selectively removed from a product stream of a conventional barite grinding plant, which may include selectively removing the fines from a conventional API-grade barite grinding operation. Fines are often considered a by-product of the grinding process, and conventionally these materials are blended with courser materials to achieve API-grade barite. However, in accordance with the present disclosure, these by-product fines may be further processed via an air classifier to achieve the particle size distributions disclosed herein. In yet another embodiment, the micronized weighting agents may be formed by chemical precipitation. Such precipitated products may be used alone or in combination with mechanically milled products.

In some embodiments, the micronized weighting agents include solid colloidal particles having a deflocculating agent or dispersant coated onto the surface of the particle. Further, one of ordinary skill would appreciate that the term "colloidal" refers to a suspension of the particles, and does not impart any specific size limitation. Rather, the size of the micronized weighting agents of the present disclosure may vary in range and are only limited by the claims of the present application. The micronized particle size generates high density suspensions or slurries that show a reduced tendency to sediment or sag, while the dispersant on the surface of the particle controls the inter-particle interactions resulting in lower rheological profiles. Thus, the combination of high density, fine particle size, and control of colloidal interactions by surface coating the particles with a dispersant reconciles the objectives of high density, lower viscosity and minimal sag.

In some embodiments, a dispersant may be coated onto the particulate weighting additive during the comminution (grinding) process. That is to say, coarse weighting additive is ground in the presence of a relatively high concentration of dispersant such that the newly formed surfaces of the fine particles are exposed to and thus coated by the dispersant. It is speculated that this allows the dispersant to find an acceptable conformation on the particle surface thus coating the surface. Alternatively, it is speculated that because a relatively higher concentration of dispersant is in the grinding fluid, as opposed to that in a drilling fluid, the dispersant is more likely to be absorbed (either physically or chemically) to the particle surface. As that term is used in herein, "coating of the surface" is intended to mean that a sufficient number of dispersant molecules are absorbed physically or chemically) or otherwise closely associated with the surface of the particles so that the fine particles of material do not cause the rapid rise in viscosity observed in the prior art. By using such a definition, one of skill in the art should understand and appreciate that the dispersant molecules may not actually be fully covering the particle surface and that quantification of the number of molecules is very difficult. Therefore, by necessity, reliance is made on a results oriented definition. As a result of the process, one can control the colloidal interactions of the fine particles by coating the particle with dispersants prior to addition to the drilling fluid. By doing so, it is possible to systematically control the rheological properties of fluids containing in the additive as well as the tolerance to contaminants in the fluid in addition to enhancing the fluid loss (filtration) properties of the fluid.

In some embodiments, the weighting agents include dispersed solid colloidal particles with a weight average particle diameter ($d_{50}$) of less than 10 microns that are coated with a polymeric deflocculating agent or dispersing agent. In other embodiments, the weighting agents include dispersed solid colloidal particles with a weight average particle diameter ($d_{50}$) of less than 8 microns that are coated with a polymeric deflocculating agent or dispersing agent; less than 6 microns in other embodiments; less than 4 microns in other embodiments; and less than 2 microns in yet other embodiments. The fine particle size will generate suspensions or slurries that will show a reduced tendency to sediment or sag, and the polymeric dispersing agent on the surface of the particle may control the inter-particle interactions and thus will produce lower Theological profiles. It is the combination of fine particle size and control of colloidal interactions that reconciles the two objectives of lower viscosity and minimal sag. Additionally, the presence of the dispersant in the comminution process yields discrete particles which can form a more efficiently packed filter cake and so advantageously reduce filtration rates.

Coating of the micronized weighting agent with the dispersant may also be performed in a dry blending process such that the process is substantially free of solvent. The process includes blending the weighting agent and a dispersant at a desired ratio to form a blended material. In one embodiment, the weighting agent may be un-sized initially and rely on the blending process to grind the particles into the desired size range as disclosed above. Alternatively, the process may begin with sized weighting agents. The blended material may then be fed to a heat exchange system, such as a thermal desorption system. The mixture may be forwarded through the heat exchanger using a mixer, such as a screw conveyor. Upon cooling, the polymer may remain associated with the weighting agent. The polymer/weighting agent mixture may then be separated into polymer coated weighting agent, unassociated polymer, and any agglomerates that may have formed. The unassociated polymer may optionally be recycled to the beginning of the process, if desired. In another embodiment, the dry blending process alone may serve to coat the weighting agent without heating.

Alternatively, a sized weighting agent may be coated by thermal adsorption as described above, in the absence of a dry blending process. In this embodiment, a process for making a coated substrate may include heating a sized weighting agent to a temperature sufficient to react monomeric dispersant onto the weighting agent to form a polymer coated sized weighting agent and recovering the polymer coated weighting agent. In another embodiment, one may use a catalyzed process to form the polymer in the presence of the sized weighting agent. In yet another embodiment, the polymer may be preformed and may be thermally adsorbed onto the sized weighting agent.

In some embodiments, the micronized weighting agent may be formed of particles that are composed of a material of specific gravity of at least 2.3; at least 2.4 in other embodiments; at least 2.5 in other embodiments; at least 2.6 in other embodiments; and at least 2.68 in yet other embodiments. For example, a weighting agent formed of particles having a specific gravity of at least 2.68 may allow wellbore fluids to be formulated to meet most density requirements yet have a particulate volume fraction low enough for the fluid to be pumpable.

As mentioned above, embodiments of the micronized weighting agent may include a deflocculating agent or a dispersant. In one embodiment, the dispersant may be selected from carboxylic acids of molecular weight of at least 150 Daltons, such as oleic acid and polybasic fatty acids, alkylbenzene sulphonic acids, alkane sulphonic acids, linear alpha-olefin sulphonic acids, phospholipids such as lecithin, including salts thereof and including mixtures thereof Synthetic polymers may also be used, such as HYPERMER OM-1 (Imperial Chemical Industries, PLC, London, United Kingdom) or polyacrylate esters, for example. Such polyacrylate esters may include polymers of stearyl methacrylate and/or butylacrylate. In another embodiment, the corresponding acids methacrylic acid and/or acrylic acid may be used. One skilled in the art would recognize that other acrylate or other unsaturated carboxylic acid monomers (or esters thereof) may be used to achieve substantially the same results as disclosed herein.

When a dispersant coated micronized weighting agent is to be used in water-based fluids, a water soluble polymer of molecular weight of at least 2000 Daltons may be used in a particular embodiment. Examples of such water soluble polymers may include a homopolymer or copolymer of any monomer selected from acrylic acid, itaconic acid, maleic acid or anhydride, hydroxypropyl acrylate vinylsulphoniac acid, acrylamido 2-propane sulphonic acid, acrylamide, styrene sulphonic acid, acrylic phosphate esters, methyl vinyl ether and vinyl acetate or salts thereof.

The polymeric dispersant may have an average molecular weight from about 10,000 Daltons to about 300,000 Daltons in one embodiment, from about 17,000 Daltons to about 40,000 Daltons in another embodiment, and from about 200,000-300,000 Daltons in yet another embodiment. One of ordinary skill in the art would recognize that when the dispersant is added to the weighting agent during a grinding process, intermediate molecular weight polymers (10,000-300,000 Daltons) may be used.

Further, it is specifically within the scope of the embodiments disclosed herein that the polymeric dispersant be polymerized prior to or simultaneously with the wet or dry blending processes disclosed herein. Such polymerizations may involve, for example, thermal polymerization, catalyzed polymerization, initiated polymerization or combinations thereof.

Given the particulate nature of the micronized and dispersant coated micronized weighting agents disclosed herein, one of skill in the art should appreciate that additional components may be mixed with the weighting agent to modify various macroscopic properties. For example, anti-caking agents, lubricating agents, and agents used to mitigate moisture build-up may be included. Alternatively, solid materials that enhance lubricity or help control fluid loss may be added to the weighting agents and drilling fluid disclosed herein. In one illustrative example, finely powdered natural graphite, petroleum coke, graphitized carbon, or mixtures of these are added to enhance lubricity, rate of penetration, and fluid loss as well as other properties of the drilling fluid. Another illustrative embodiment utilizes finely ground polymer materials to impart various characteristics to the drilling fluid. In instances where such materials are added, it is important to note that the volume of added material should not have a substantial adverse impact on the properties and performance of the drilling fluids. In one illustrative embodiment, polymeric fluid loss materials comprising less than 5 percent by weight are added to enhance the properties of the drilling fluid. Alternatively, less than 5 percent by weight of suitably sized graphite and petroleum coke are added to enhance the lubricity and fluid loss properties of the fluid. Finally, in another illustrative embodiment, less than 5 percent by weight of a conventional anti-caking agent is added to assist in the bulk storage of the weighting materials.

Other additives that may be included in the wellbore fluids disclosed herein include for example, wetting agents, organophilic clays, viscosifiers, fluid loss control agents, surfactants, dispersants, interfacial tension reducers, pH buffers, mutual solvents, thinners, thinning agents and cleaning agents. The addition of such agents should be well known to one of ordinary skill in the art of formulating drilling fluids and muds.

The particulate materials as described herein (i.e., the coated and/or uncoated micronized weighting agents) may be added to a drilling fluid as a weighting agent in a dry form or concentrated as slurry in either an aqueous medium or as an organic liquid. As is known, an organic liquid should have the necessary environmental characteristics required for additives to oil-based drilling fluids. With this in mind, the oleaginous fluid may have a kinematic viscosity of less than 10 centistokes (10 $mm^2/s$) at 40° C. and, for safety reasons, a flash point of greater than 60° C. Suitable oleaginous liquids are, for example, diesel oil, mineral or white oils, n-alkanes or synthetic oils such as alpha-olefin oils, ester oils, mixtures of these fluids, as well as other similar fluids known to one of skill in the art of drilling or other wellbore fluid formulation. In one embodiment, the desired particle size distribution is achieved via wet milling of the courser materials in the desired carrier fluid.

The sized particles described above (i.e., the coated and/or uncoated micronized weighting agents) may be used in any wellbore fluid such as drilling, cementing, completion, packing, work-over (repairing), stimulation, well killing, spacer fluids, and other uses of high density fluids, such as in a dense media separating fluid or in a ship's or other vehicle's ballast fluid. Such alternative uses, as well as other uses, of the present fluid should be apparent to one of skill in the art given the present disclosure. In accordance with one embodiment, the weighting agents may be used in a wellbore fluid formulation. The wellbore fluid may be a water-based fluid, a direct emulsion, an invert emulsion, or an oil-based fluid.

Water-based wellbore fluids may have an aqueous fluid as the base liquid and at least one of a micronized and a dispersant coated micronized weighting agent. The aqueous fluid may include at least one of fresh water, sea water, brine, mixtures of water and water-soluble organic compounds and mixtures thereof. For example, the aqueous fluid may be formulated with mixtures of desired salts in fresh water. Such salts may include, but are not limited to alkali metal chlorides, hydroxides, or carboxylates, for example. In various embodiments of the drilling fluid disclosed herein, the brine may include seawater, aqueous solutions wherein the salt concentration is less than that of sea water, or aqueous solutions wherein the salt concentration is greater than that of sea water. Salts that may be found in seawater include, but are not limited to, sodium, calcium, aluminum, magnesium, potassium, strontium, silicon, and lithium, and salts of chlorides, bromides, carbonates, iodides, chlorates, bromates, formates, sulfates, phosphates, nitrates, oxides, and fluorides. Salts that may be incorporated in a brine include any one or more of those present in natural seawater or any other organic or inorganic dissolved salts. Additionally, brines that may be used in the drilling fluids disclosed herein may be natural or synthetic, with synthetic brines tending to be much simpler in constitution. In one embodiment, the density of the drilling fluid may be controlled by increasing the salt concentration in the brine (up to saturation). In a particular embodiment, a brine may include halide or carboxylate salts of mono- or divalent cations of metals, such as cesium, potassium, calcium, zinc, and/or sodium.

The oil-based/invert emulsion wellbore fluids may include an oleaginous continuous phase, a non-oleaginous discontinuous phase, and at least one of a micronized and a dispersant coated micronized weighting agent. One of ordinary skill in the art would appreciate that the dispersant coated weighting agents described above may be modified in accordance with the desired application. For example, modifications may include the hydrophilic/hydrophobic nature of the dispersant.

The oleaginous fluid may be a liquid, such as a natural or synthetic oil, and in some embodiments is selected from the group including diesel oil; mineral oil; a synthetic oil, such as hydrogenated and unhydrogenated olefins including polyolefins, linear and branch olefins and the like, polydiorganosiloxanes, siloxanes, or organosiloxanes, esters of fatty acids, specifically straight chain, branched and cyclical alkyl ethers of fatty acids, mixtures thereof and similar compounds known to one of skill in the art; and mixtures thereof. The concentration of the oleaginous fluid should be sufficient so that an invert emulsion forms, and may be less than about 99 percent by volume of the invert emulsion. In one embodiment, the amount of oleaginous fluid is from about 30 percent to about 95 percent by volume and more preferably about 40 percent to about 90 percent by volume of the invert emulsion fluid. The oleaginous fluid, in one embodiment, may include at least 5 percent by volume of a material selected from the group including esters, ethers, acetals, dialkylcarbonates, hydrocarbons, and combinations thereof.

The non-oleaginous fluid used in the formulation of the invert emulsion fluid disclosed herein is a liquid and may be an aqueous liquid. In one embodiment, the non-oleaginous liquid may be selected from the group including sea water, a brine containing organic and/or inorganic dissolved salts, liquids containing water-miscible organic compounds and combinations thereof. The amount of the non-oleaginous fluid is typically less than the theoretical limit needed for forming an invert emulsion. Thus, in one embodiment, the amount of non-oleaginous fluid is less that about 70 percent by volume and preferably from about 1 percent to about 70 percent by volume. In another embodiment, the non-oleaginous fluid is preferably from about 5 percent to about 60 percent by volume of the invert emulsion fluid. The fluid phase may include either an aqueous fluid or an oleaginous fluid, or mixtures thereof. In a particular embodiment coated barite or other weighting agents may be included in a wellbore fluid comprising an aqueous fluid that includes at least one of fresh water, sea water, brine, and combinations thereof.

The fluids disclosed herein are especially useful in the drilling, completion and working over of subterranean oil and gas wells. In particular the fluids disclosed herein may find use in formulating drilling muds and completion fluids that allow for the easy and quick removal of the filter cake. Such muds and fluids are especially useful in the drilling of horizontal wells into hydrocarbon bearing formations.

Conventional methods may be used to prepare the drilling fluids disclosed herein in a manner analogous to those normally used, to prepare conventional water- and oil-based drilling fluids. In one embodiment, a desired quantity of water-based fluid and a suitable amount of at least one of the micronized and the dispersant coated micronized weighting agents are mixed together and the remaining components of the drilling fluid added sequentially with continuous mixing. In another embodiment, a desired quantity of oleaginous fluid, such as a base oil, a non-oleaginous fluid, and a suitable amount of the micronized and/or dispersant coated micronized weighting agent are mixed together and the remaining components are added sequentially with continuous mixing. An invert emulsion may be formed by vigorously agitating, mixing or shearing the oleaginous fluid and the non-oleaginous fluid.

The drilling fluids, cement and cementing fluids, spacer fluids, other high density fluids, and coiled tubing drilling fluids may be used for controlling casing annulus pressure. In some embodiments, the particulate weighting agents described herein have the ability to stabilize the laminar flow regime, and delay the onset of turbulence. It is possible to formulate fluids for several applications that will be able to be pumped faster before turbulence is encountered, so giving essentially lower pressure drops at equivalent flow rates. This ability to stabilize the laminar flow regime, although surprising, is adequately demonstrated in heavy density muds of 20 pounds per gallon (2.39 g/cc) or higher. Such high density muds using conventional weighting agents, with a weight average particle diameter of 10 to 30 microns, would exhibit dilatancy with the concomitant increase in the pressure drops due to the turbulence generated. The ability of micronized weighting agents described herein to stabilize the flow means that high density fluids with acceptable rheology are feasible with lower pressure drops.

Drilling fluids disclosed herein having a lower pressure drop may result in operating and/or capital cost savings. For example, lower pressure drops may translate into decreased energy usage at the same flow rates. Alternatively, lower horsepower requirements for the drilling fluid pumps could result in decreased equipment costs.

The properties of the drilling fluids disclosed herein may allow for the drilling fluid to meet the requirements of low sag during drilling, including horizontal drilling, and low settling of drilled solids and weighting agents when the drilling fluid is static. It has also been found, in some embodiments, that drilling fluids described herein may also provide for an increased rate of penetration when drilling. Drilling fluids having lower Theological profiles as described herein may allow an operator to achieve higher drilling fluid flow rates. Higher drilling fluid flow rates, in turn, may result in improved drilled solids removal from the bit area, including the annulus near the bit.

For example, the higher flow rates may increase the turbulence of the drilling fluid flowing around the bit, allowing debris (drilled solids) to be removed more efficiently than when using a higher rheology fluid. The efficient removal of debris from the bit area may thus allow for operators to achieve greater rates of penetration due to increased drilling efficiency, and may reduce the time required to drill and, consequently, reduce drilling costs. It is also theorized that the smaller weighting agent particles used in the drilling fluids disclosed herein may contribute to the increased debris removal efficiency.

EXAMPLE

As compared to a typical drilling fluid of similar density, sag and settling properties, embodiments of the drilling fluids disclosed herein may allow for greater rates of penetration when drilling. The increased rates of penetration may be exemplified as follows.

A baseline drilling fluid, comprising an API-grade barite weighting agent, and a drilling fluid according to embodiments disclosed herein are used to drill a wellbore. The baseline drilling fluid and the drilling fluid according to embodiments disclosed herein, containing a dispersant coated weighting agent, are each of similar weight (density). Drilling is performed under equivalent conditions, including bore diameter, formation type, annulus diameter, and drill string length.

The baseline drilling fluid comprising an API-grade barite weighting agent may have a given sag, settling rate, and density. Drilling may be performed at a given drilling fluid flow rate, resulting in a certain pressure drop through the drillstring, and the given flow rate and pressure drop result. The maximum rate of penetration while drilling is then measured.

A drilling fluid according to embodiment disclosed herein includes at least one of a micronized weighting agent and a dispersant coated micronized weighting agent, and has similar or lower sag, similar or lower settling rates, and a similar density as compared to the baseline drilling fluid. The drilling fluid flow rate is increased above that of the baseline drilling fluid. The fluid flow rate is increased until an equivalent pressure drop through the drill string as compared to the baseline drilling fluid results, and the maximum rate of penetration while drilling is measured. The maximum rate of penetration using the drilling fluid containing a micronized and/or dispersant coated weighting agent according to embodiments disclosed herein is greater than the maximum rate of penetration using the baseline drilling fluid.

In some embodiments, the maximum rate of penetration using drilling fluids having at least one of a micronized and a dispersant coated micronized weighting agent may be at least 2.5 percent greater than the maximum rate of penetration using a drilling fluid containing an API-grade barite weighting agent (baseline drilling fluid). In other embodiments, the maximum rate of penetration may be at least 5 percent greater than when using a baseline drilling fluid; at least 7.5 percent greater in other embodiments; and at least 10 percent greater in yet other embodiments.

In some embodiments, a higher rate of penetration may be achieved using a drilling fluid having at least one of a micronized and a dispersant coated weighting agent, wherein the drilling fluid flow rate may be at least 5 percent greater than a baseline drilling fluid flow rate at an equivalent or lower pressure drop. In other embodiments, a higher rate of penetration may be achieved using a drilling fluid having at least one of a micronized and a dispersant coated weighting agent, wherein the drilling fluid flow rate may be at least 7.5 percent greater than a baseline drilling fluid flow rate at an equivalent or lower pressure drop; the drilling fluid flow rate may be at least 10 percent greater than a baseline drilling fluid flow rate at an equivalent or lower pressure drop in other embodiments; the drilling fluid flow rate may be at least 12.5 percent greater than a baseline drilling fluid flow rate at an equivalent or lower pressure drop in other embodiments; and the drilling fluid flow rate may be at least 15 percent greater than a baseline drilling fluid flow rate at an equivalent or lower pressure drop in yet other embodiments.

In some embodiments, the pressure drop using a drilling fluid having at least one of a micronized and a dispersant coated weighting agent may be at least 2.5 percent lower than the pressure drop of the baseline drilling fluid at an equivalent or higher flow rate. In other embodiments, the pressure drop using a drilling fluid having at least one of a micronized and a dispersant coated weighting agent may be at least 5 percent lower than the pressure drop of the baseline drilling fluid at an equivalent or higher flow rate; at least 7.5 percent lower than the pressure drop of the baseline drilling fluid at an equivalent or higher flow rate in other embodiments; at least 10 percent lower than the pressure drop of the baseline drilling fluid at an equivalent or higher flow rate in other embodiments; at least 12.5 percent lower than the pressure drop of the baseline drilling fluid at an equivalent or higher flow rate in other embodiments; and at least 15 percent lower than the pressure drop of the baseline drilling fluid at an equivalent or higher flow rate in yet other embodiments.

Advantageously, embodiments of the present disclosure may provide for higher rates of penetration when drilling. As compared to typical drilling fluids containing API-grade barite weighting agents, embodiments of the drilling fluid disclosed herein, the drilling fluid comprising a base fluid and at least one of a micronized and a dispersant coated weighting agent, may allow for greater rates of penetration when drilling to be achieved, while at the same time having one or more of: an equivalent or lower sag, an equivalent or lower settling rate, an equivalent density (weight), a similar base fluid composition (oil-water ratio), an equivalent or lower pressure drop, and increased turbulence in the bit area and near bit region of the annulus.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A method of increasing a rate of penetration when drilling as compared to drilling with a baseline drilling fluid comprising a base fluid and an API-grade barite weighting agent and having a given sag, settling rate, weight, flow rate, and pressure drop through a wellbore, comprising:

circulating a drilling fluid comprising a base fluid and at least one micronized weighting agent having a particle size $d_{90}$ of less than about 10 microns through the wellbore;

wherein the drilling fluid is characterized as having an equivalent weight, an equivalent or lower settling rate, and an equivalent or lower sag than the baseline drilling fluid;

wherein the circulating is at a higher flow rate than the baseline drilling fluid flow rate; and wherein the circulating results in an equivalent or lower pressure drop through the wellbore.

2. The method of claim 1, wherein the flow rate is at least 5 percent higher than the baseline drilling fluid flow rate at an equivalent or lower pressure drop.

3. The method of claim 1, wherein the flow rate is at least 10 percent higher than the baseline drilling fluid flow rate at an equivalent or lower pressure drop.

4. The method of claim 1, wherein the pressure drop is at least 5 percent lower than the pressure drop of the baseline drilling fluid at an equivalent or higher flow rate.

5. The method of claim 1, wherein the pressure drop is at least 10 percent lower than the pressure drop of the baseline drilling fluid at an equivalent or higher flow rate.

6. The method of claim 1, wherein the rate of penetration is at least 5 percent greater than the rate of penetration with the baseline drilling fluid.

7. The method of claim 1, wherein the rate of penetration is at least 10 percent greater than the rate of penetration with the baseline drilling fluid.

8. The method of claim 1, wherein the micronized weighting agent is at least one selected from barite, calcium carbonate, dolomite, ilmenite, hematite, olivine, siderite, manganese oxide, and strontium sulfate.

9. The method of claim 1, wherein the micronized weighting agent is coated with a dispersant made by the method comprising dry blending a micronized weighting agent and a dispersant to form a micronized weighting agent coated with the dispersant.

10. The method of claim 1, wherein the micronized weighting agent comprises colloidal particles having a coating thereon.

11. The method of claim 1, wherein the micronized weighting agent has a particle size $d_{90}$ of less than about 5 microns.

12. The method of claim 1, wherein the coating comprises at least one selected from oleic acid, polybasic fatty acids, alkylbenzene sulfonic acids, alkane sulfonic acids, linear alpha-olefin sulfonic acids, alkaline earth metal salts thereof, polyacrylate esters, and phospholipids.

13. The method of claim 1, wherein the base fluid is at least one of an oleaginous fluid and a non-oleaginous fluid.

14. A method of drilling a wellbore, comprising circulating a drilling fluid comprising a base fluid and at least one micronized weighting agent having a particle size $d_{90}$ of less than about 10 microns through the wellbore;

wherein the drilling fluid comprising at least one micronized weighting agent has a given weight, sag, and settling rate; and wherein the drilling is characterized as having an improved rate of penetration as compared to drilling with a drilling fluid comprising an API-grade barite weighting agent having a similar weight, sag, and settling rate.

* * * * *